US005108057A

United States Patent [19]

Dandy, III et al.

[11] Patent Number: 5,108,057

[45] Date of Patent: Apr. 28, 1992

[54] FREE SLIDING HAND REST

[76] Inventors: Walter Dandy, III, Sow's Ear House, Monkton, Md. 21111; Tony Nespor, 2515 Glencoe Rd., Baltimore, Md. 21234

[21] Appl. No.: 612,462

[22] Filed: Nov. 14, 1990

[51] Int. Cl.[5] ..... B43L 15/00; B68G 5/00

[52] U.S. Cl. ..... 248/118; 248/122

[58] Field of Search ..... 248/118, 118.1, 118.3, 248/118.5, 121, 122; 5/431, 443, 445; 211/43; 297/411, 414, 406, 407, 409

[56] References Cited

U.S. PATENT DOCUMENTS

| | | | |
|---|---|---|---|
| 360,529 | 4/1887 | Jurey . | |
| 520,711 | 5/1894 | Shea | 248/118.5 |
| 607,675 | 7/1898 | Barr . | |
| 1,277,169 | 8/1918 | Anderson . | |
| 1,296,722 | 5/1919 | Washburn | 5/443 X |
| 1,611,084 | 12/1926 | Storey . | |
| 1,632,160 | 6/1927 | Barnes | 248/118 X |
| 2,318,841 | 5/1943 | Dodge | 248/118 |
| 3,171,542 | 3/1965 | Jacobs et al. | 211/43 |
| 4,069,995 | 1/1978 | Miller | 248/118.1 |
| 4,481,556 | 11/1984 | Berke et al. . | |
| 4,482,063 | 11/1984 | Berke et al. . | |
| 4,482,064 | 11/1984 | Berke et al. . | |
| 4,545,554 | 10/1985 | Latino et al. . | |
| 4,621,781 | 11/1986 | Springer . | |
| 4,688,862 | 8/1987 | Fowler et al. . | |
| 4,913,390 | 4/1990 | Berke . | |
| 4,934,647 | 6/1990 | Edwards | 248/346 |
| 4,996,977 | 3/1991 | Tiedeken | 248/118 X |
| 5,004,196 | 4/1991 | Gross | 248/118.3 |

FOREIGN PATENT DOCUMENTS

| | | | |
|---|---|---|---|
| 17243 | 3/1882 | Fed. Rep. of Germany | 248/118.5 |
| 57540 | 1/1891 | Fed. Rep. of Germany | 248/118.5 |
| 139421 | 3/1903 | Fed. Rep. of Germany | 248/118.3 |
| 42022 | 10/1965 | Fed. Rep. of Germany | 248/118 |
| 8900111 | 1/1989 | PCT Int'l Appl. . | |

*Primary Examiner*—Karen J. Chotkowski

[57] ABSTRACT

A free sliding hand rest particularly for use as a typing assist device includes a pair of end brackets which support highly polished stainless steel bars therebetween and free sliding resting pads easily movable on the stainless steel bars. The resting pads are configured to simulate and thereby accommodate curves in an operator's hand and wrist for enabling relaxed and proper positioning of the hands for extended periods of typing or key input operations.

7 Claims, 3 Drawing Sheets

FIG. 5
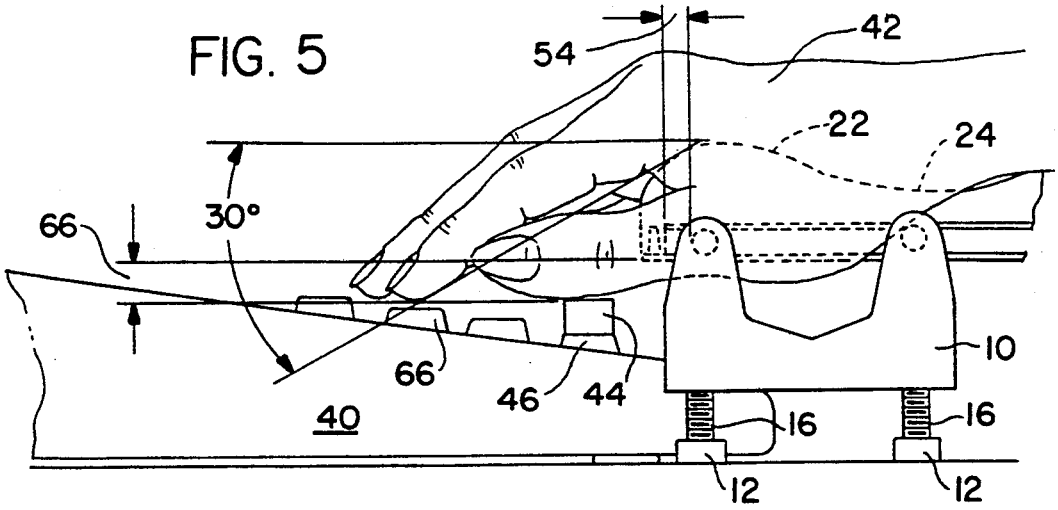
FIG. 6
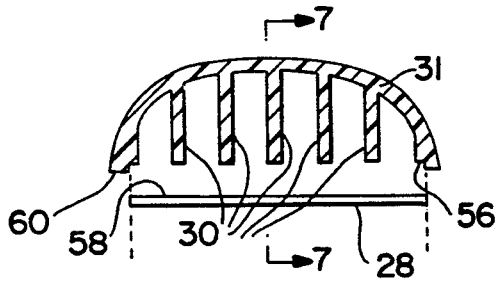
FIG. 7
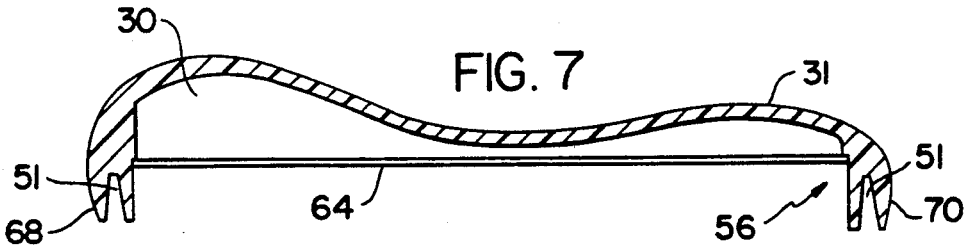
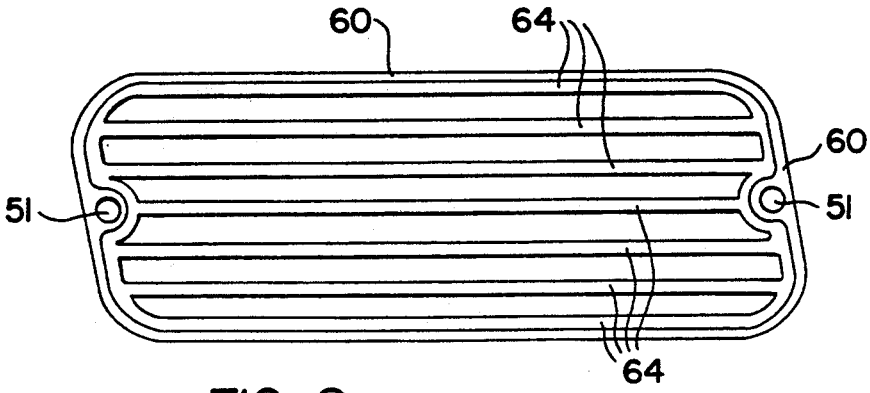
FIG. 8

FREE SLIDING HAND REST

BACKGROUND OF THE INVENTION

1. Field of the Invention

The present invention relates to a free sliding hand rest, and more particularly to a free sliding hand rest for use as a typing assist device.

2. Description of Related Art

It is well known that prolonged use of a typewriter or other similar keyboard causes great fatigue to an operator, particularly to the arms and back thereof since the arms are held unsupported while subject to motion. The need to provide hand and arm support for keyboard operators has been known. However, an effective support device which supports without inhibiting motion, is unconfining, and enables equal or greater typing speed than without such an assist device has not previously been achieved.

For example, it has been known to physically suspend the forearms from an overhanging frame or support with arm rests suspended from the support in front of the keyboard such as that shown in U.S. Pat. No. 360,529 to Jurey issued on Apr. 5, 1887. More recently, fixed arm or wrists supports have been provided in front of a keyboard, the fixed supports most often supporting both the arm, the keyboard and/or the computer terminal all at the same time. These devices do not support alacrity of movement required to reach all locations on the keyboard and in fact still exact a substantial toll on the hands and the arms and body for frequent lifting and placing about a keyboard.

Typing strain may be due to the tense and inaccurate position of the operator's hand. This strain eventually manifests as fatigue or pains of the wrist, the forearm, the shoulder, the back, and the neck of the operator. Further, such strain is caused by the posture and hand position required for typing. In order to compensate for this strain, operators often develop improper posture which only aggravates their painful condition.

Recent attention has been given to the problem of repetitive strain injury (RSI) that journalists and computer operators encounter which leads to neck, wrist, hand and arm pain. With the advent of automation, more and more workers are spending their days in front of a computer and as of 1988 nearly half of all work place illnesses in private industry were the result of repetitive strain injury.

In particular, long hours at the computer or a keyboard put continuous stress on the wrists, elbows and shoulders. Tendons in the arm become inflamed, thereby squeezing nerves, resulting in numbness and pain. These injuries often develop into serious lifelong disabilities and loss of ability to continue the work which caused them.

Cumulative trauma disorders (CTD), known as the industrial disease of the information age include carpal tunnel syndrome, a severe form of CTD concentrated in the carpal bones of the hand and wrist which is known to be a direct result of the repetitive typing motion required of keyboard operators.

Even though knowledge of these disorders has increased and their source is understood, the industry has been slow to take preventative measures.

SUMMARY OF THE INVENTION

Accordingly, it is a primary object of the present invention to provide a free sliding hand rest which will alleviate wrist, arm, shoulder and back pain resulting from the anatomy's inadequacy at supporting the extended repetitively moving hands of the keyboard operator.

It is another object of the present invention to provide a free sliding hand rest which will be a typing assist device for all aspects of typing.

It is still a further object of the present invention to eliminate superfluous typing motions and enforce the classical style of a relatively still hand.

It is still a further object to reduce ulnar deflection or laterial wrist movement.

It is still another object of the present invention to replace and/or augment much of the body's support needs during typing.

The objects of the present invention are fulfilled by providing an apparatus for supporting the hands and wrists of an operator during actuation of a keyboard or the like with the operator's fingers, comprising:

means for supporting said apparatus at a position adjacent the keyboard;

rest means for supporting the hands and wrists of the operator during actuation of the keyboard in positions that minimize strain to the wrists, arms and body of the operator; and guide means for supporting said rest means for free, slidable, planar movement thereon in all directions within a plane just above the top surface of the keyboard, the degree of movement permitted by the rest means in said plane being sufficient for an operator to actuate each key on the keyboard while the hands and wrists are maintained in said positions on the rest means.

Further scope of applicability of the present invention will become apparent from the detailed description given hereafter. However, it should be understood that the detailed description and specific examples, while indicating preferred embodiments of the invention, are given by way of illustration only since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way illustration only, and thus are not limitative of the present invention and wherein:

FIG. 5 is a side elevational view showing a position of a hand on the free sliding hand rest in relationship to a keyboard;

FIG. 6 is a cross-sectional view of a resting pad for use in the embodiment shown in FIG. 1;

FIG. 7 is a lengthwise sectional view of the resting pad shown in FIG. 1; and

FIG. 8 is a bottom view of the resting pad portion shown in FIG. 7.

DESCRIPTION OF PREFERRED EMBODIMENT

Figure 1:
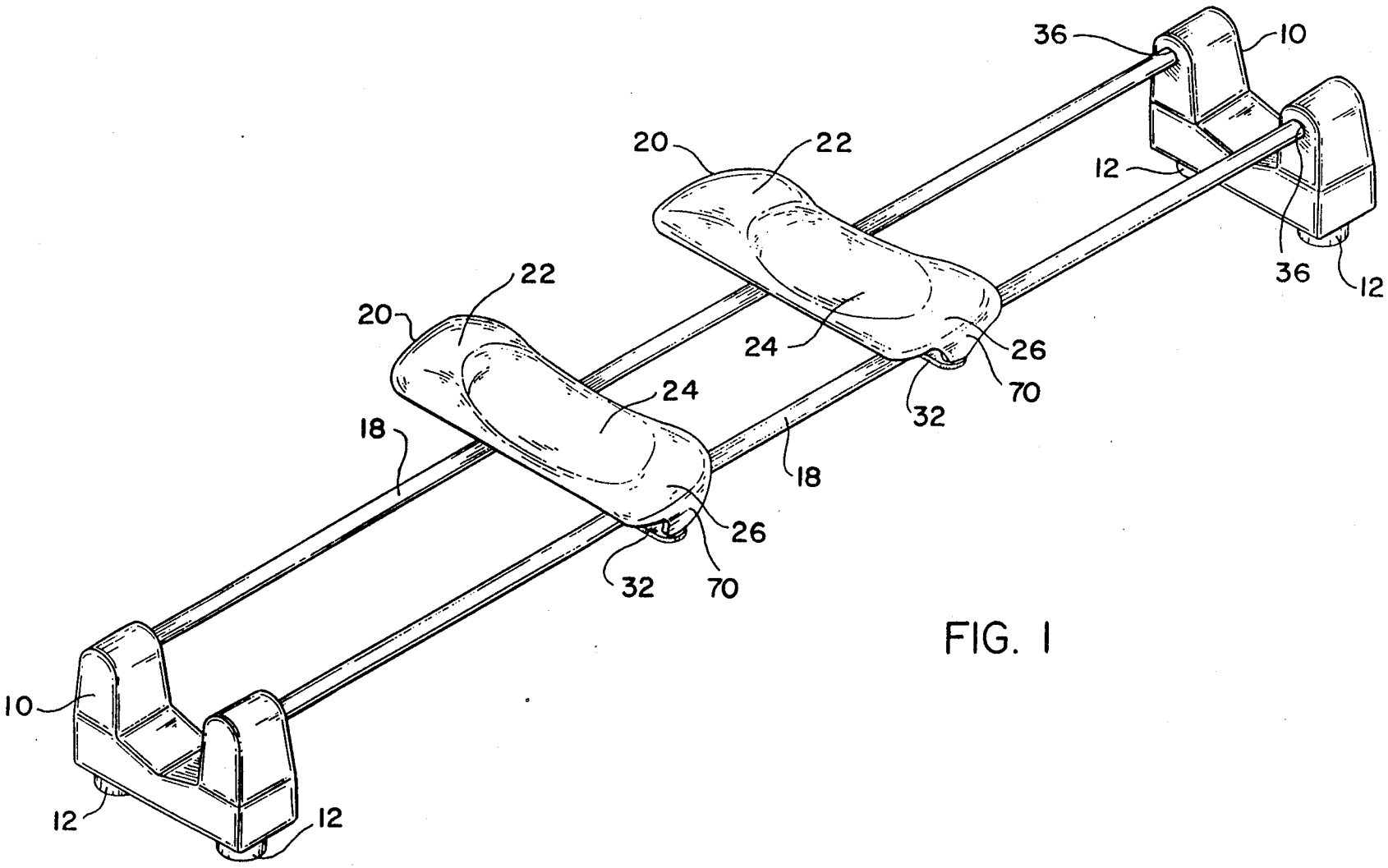
FIG. 1 is a perspective view of the free sliding hand rest according to a preferred embodiment of the present invention.

Referring to FIG. 1, there is generally shown a perspective view of the free sliding hand rest of the present invention.

The device includes a pair of end brackets 10 having high-friction adjustable feet 12 mounted in the base of each bracket 10. In particular, there are two adjustable feet 12 per end bracket 10, the feet being adjustable to raise the forward or rearward portion of the device as required by an operator.

A pair of parallel bars 18 are mounted between the end brackets 10, opposing ends of each parallel bar 18 being inserted into apertures 36 in the brackets 10 in a manner suitable to prevent free removal of the bars from the end brackets.

Mounted on the parallel bars 18 are a pair of resting pads 20 upon which the operator's hands are supported in a relaxed manner during key input operations. Each of the resting pads 20 includes a palm support 22 which conforms to the concave shape of an operator's palm, a slightly recessed heel support 24 in which the heel of the hand will rest, and a wrist support 26 for supporting the associated wrist in a horizontal relationship with respect to a table top surface 48 or the like. Regarding the relationship of supports 22, 24, and 26, it should be understood that the palm support 22 is adjacent a forward or front side 68 of the free sliding hand rest device while the wrist support 26 is adjacent a rearward side 70 of the device closest to an operator. This orientation of parts is constant and movement of the resting pads 20 with respect to the keyboard is achieved through an application of light force to the resting pads in an appropriate direction by the operator's hands.

Each of the parallel bar members 18 are of a highly polished metal such as stainless steel and may be impregnated with silicone or any other similar anti-friction substance in order to assist in the free sliding of hand rests 20 thereover.

Assisting in the ease of movement of the resting pads 20 across the bar members 18 is the fact that the resting pads 20 are extremely light-weight thereby eliminating resistance to the operator. The light weight in combination with the anti-friction surfaces offers an effortless propulsion of the resting pads for virtually any operator.

Figure 2:
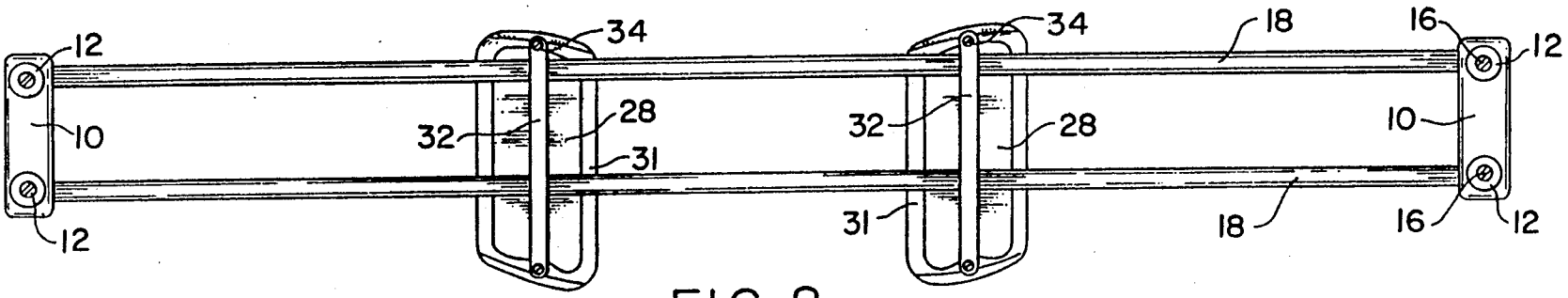
FIG. 2 is a bottom perspective view of the free sliding hand rest shown in FIG. 1.

Referring now to FIG. 2, which shows a bottom perspective view of the hand rest shown in FIG. 1, it can be seen that each of the resting pads 20 includes a strap member 32 secured around the underneath or bottom of the parallel bars 18 in order to prevent the resting pads from becoming separated from the parallel bars 18. Each of the strap attachments 32 are fixed to front 68 and rear ends 70 respectively, of the resting pad 20 by a fastening means such as a screw 34 which is simply screwed into an appropriate portion of the resting pad. Any suitable fastening means may be used, however, as later shown and described with respect to FIG. 4. As also shown in FIG. 2, the base portion of the resting pads 20 include an anti-friction pad 28 made of virgin teflon or the like, the anti-friction pad 28 being configured to fit securely within an outer shell 31 of the resting pad 20.

As also shown in FIG. 2, each of the plurality of feet 12 are mounted at forward and rearward portions of the brackets 10 in order to provide a high friction and stable contact with a work surface such as table top 48.

Figure 3:
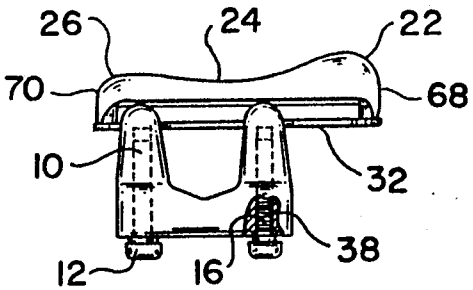
FIG. 3 is a partially broken away view showing the right end of the free sliding hand rest shown in FIG. 1.

FIG. 3 shows a side elevational view of a right end of the free sliding hand rest device of FIG. 1. In this figure, it can be clearly seen that the palm support 22 is substantially higher than the rear wrist support 26 and that the heel support 24 is an indentation therebetween which will properly accommodate the heel of a hand. The strap 34 is shown to be spaced apart from the base or frictionless pad 28 of the resting pad 20 by a sufficient distance to be strapped around the parallel bars 18 (not shown in this figure). The portion of FIG. 3 broken away shows that each of the high friction feet 12 may be threadedly engaged with the base of brackets 10, the screw threads being shown at 16 and the threaded apertures for the feet being shown as 38. Each of the high friction feet 12 is independently adjustable to thereby accommodate uneven work surfaces or a need for the operator to have the front portion including a palm support 22 positioned higher than the rear portion including the wrist support 26. In other instances, it may be desirable for the operator to slightly raise the wrist support portion 26 of the resting pad 20 in which case the adjustable feet beneath this portion of the resting pad may be unscrewed from the respective threaded apertures in order to raise the rear portion of the device.

Figure 4:
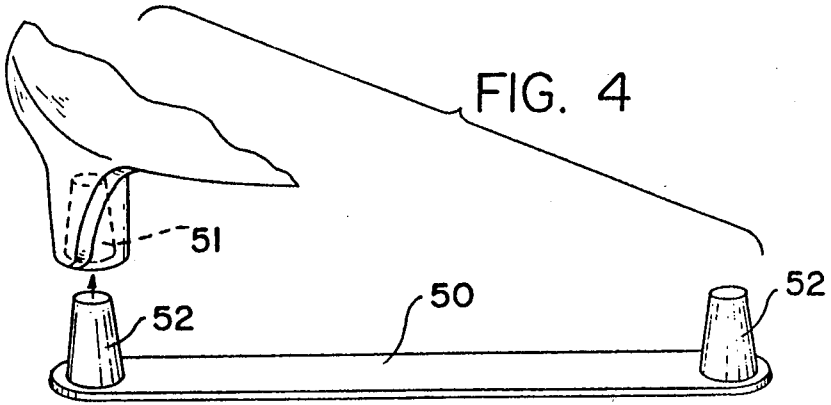
FIG. 4 illustrates an alternative strap and attachment assembly for use in the free sliding hand rest shown in FIG. 1.

As shown in FIG. 4, an alternative means for securing the resting pads 20 to the parallel bars 18 may be achieved by the use of strap 50 having truncated conical pegs 52 formed on each end thereof. These truncated conical pegs 52 are merely inserted into conforming friction fit apertures 51 in respective ends of the resting pads 20 similar to the connection shown in FIG. 2 at 34.

FIG. 5 shows a side view of the free sliding hand rest used in connection with a keyboard 40. In this Figure, the resting pad 20 is shown in a "home" position in which the resting pad is placed at a position closest to the operator and whereby the operator's fingers are aligned with the home keys 66 of the typewriter. Although not shown, home keys for a left hand of the operator include the letters, A, S, D, and F, while the home keys for the operator's right hand include J, K, L, and ; (semicolon). All movement of the resting pads 20 are with respect to the home keys 66 as would occur when typing without aid of the free sliding hand rest.

It can be seen that the end brackets 10 enable positioning of the parallel bars 18 at a sufficient height above the work surface, while the bars are positioned slightly overlapping a portion of the keyboard which is closest to the operator. This enables easy reach by the operator to all portions of the keyboard from the home position, including the ability to slide the resting pads 20 forward in an extended position (see FIG. 3) away from the home position (FIG. 5) without jamming the forward ends of the resting pads against keys of the keyboard.

In the event that the keyboard operator cannot easily reach the space bar, a space bar extender 44 consisting of a styrofoam pad or the like may be placed on the space bar thereby enabling an easy reach of the space bar by an operator's thumbs. As also shown in FIG. 5, when a hand 42 is properly placed on the resting pads 20 with the palm of the hand positioned on the palm support 22, fingers are draped down and within easy reach of the keyboard at an angle of approximately 30° with respect to horizontal. This is a natural relaxed position of an operator's hand and will assist in the resting or relaxed position required to alleviate hand, wrist, forearm, shoulder, neck, and back pain resulting from a tensed hand position assumed by most typists at the present time. In addition, proper positioning in relation to the keyboard will result in an approximately ⅜" space 54 between a forward parallel bar 18 and the forward end of the shell 31.

As previously indicated, according to personal preference, each of the high friction feet pads 12 may be independently raised or lowered, thereby resulting in an extremely comfortable position for virtually any typist over extended periods of time.

FIG. 6 is a cross-sectional view of the resting pad 20 in which 31 is an injection molded plastic portion identified as the shell of the resting pad with the low friction teflon portion 28 being formed therebeneath. Consistent with the injection molded nature of articles, a plurality of depending ribs 30 are integrally formed in connection with the shell 31. Each of the ribs 30 terminate at distal ends 64 thereof in a planar alignment with respect to each other. At the perimeter or outer rim 60 of shell 31 is a recessed area 56 which is approximately one-half the thickness of the teflon pad 28 to be applied thereto. Of course it should be understood that the perimeter of the teflon pad 28 will be of a substantially identical shape to the outer rim 60 of shell 31. It can be seen that the teflon pad 28 will in fact be applied directly to the distal ends 64 fo ribs 30 and within recessed area 56.

Attachment of the teflon base pad 28 to the shell portion 31 and distal ends 64 of ribs 30 may be by any suitable means such as gluing, double-sided adhesive tape, or the like on surface 58 of the teflon pad 28 which will not interfere with the free sliding motion of the teflon pad over the parallel bars 18.

FIG. 7 is a longitudinal sectional view and FIG. 8 is a bottom view, respectively, of the resting pad 20 in which 31 is the shell portion and 30 are the plurality of ribs formed within the shell 31. Once again, the teflon base pad 28 will be mounted in any suitable manner within the shell 31 which will enable smooth engagement with parallel bars 18. Each of the friction-fit portions 51 are more readily seen in these Figures.

In order to enhance the sliding movement of the teflon pad 28 on bars 18, it is possible to impregnate the teflon base pad with silicone or the like, as done to the parallel bars 18 in order to further decrease the coefficient of friction therebetween and provide an even, smooth motion of the resting pads 20 over their support surface. The coefficient of friction is preferrably within the range of about 0.05 to about 0.08.

The overall device is approximately 22 inches long in order to be easily placed over the length of the keyboard and the overall height of the end brackets are approximately one and three quarter inches with the underneath portion of the parallel bars being approximately one and one quarter inch to clear the lower keys and the space bar key 46 of the keyboard. Further, the overall device is light-weight, portable, and easy for use with any keyboard arrangement situated on any surface.

In addition, the device shown and described is particularly useful as a teaching aid in order to teach students of typing or who are learning key input operations proper positioning of the hand in a relaxed manner, thereby avoiding carpal tunnel syndrome and other related disorders resulting from repetitive motion tasks such as typing. It is believed that use of the free sliding hand rest shown and described while learning to type will result in a reliance by typists on the device to facilitate operation for extended periods of time. Thereafter, these typists will be able to perform their tasks for extended periods of time by removing the need to support the hand, wrists, and arm solely by the muscles and joints, while providing the flexibility needed to type at even higher speeds and at all areas of the keyboard.

Operation of the free sliding hand rest simply requires placement of the operator's hands on the corresponding resting pads 20 when the device is placed in proximity to the keyboard at the home position.

Due to the reduced coefficient of friction between the teflon pads 28 and the highly polished steel bars 18, movement of the hands and resting pads may occur in any direction within a horizontal plane above the support surface 48. In other words, sliding movement in a forward or extended direction is sufficient to enable the operator to reach keys toward the rear of the keyboard such as numeral keys. The forward motion is limited only by the attachment of strap 32 at 34 to the shell 31 of the resting pad beneath the wrist supporting portion 26. Similarly, movement of the resting pads 20 away from the keyboard toward the home position will enable easy access to the space bar 46 and adjacent keys.

Likewise, movement of the resting pads 20 in a direction parallel to the keyboard 40 is achieved simply by sliding the operator's hands to the left or right along the parallel bars with motion in a longitudinal direction (parallel to bars 18) being limited only by the end brackets 10. Motion in a direction orthoganal to the longitudinal axis is limited only by depending forward and rear portions 68, 70 respectively of the resting pads 20. Accordingly, movement of the pads in virtually any direction including a direction at an angle with respect to the longitudinal axis of the parallel bars is possible and since each resting pad is movable independently of the other, all areas of the keyboard may be accessed by the operator as occurs when typing without the aid of the free sliding hand rest.

The invention being thus described it will be obvious that the same may be varied in many ways. Such variations are not to be regarded as a departure from the spirit and scope of the invention, and all such modifications as would be obvious to one of ordinary skill in the art are intended to be included within the scope of the following claims.

We claim:

1. Apparatus for supporting the hands and wrists of an operator during actuation of a keyboard with an operator's fingers comprising:

a support frame positionable in close proximity to said keyboard, said support frame including a pair of upstanding brackets spaced at distal ends of a longitudinal axis of the support frame and a plurality of parallel bars extending between said brackets, said bars being coplanar and defining a horizontal bearing surface; and at least one pad for supporting a hand and writs of an operator, said at least one pad having a curved upper surface conformally shaped to engage the palm and heel of an operator's hand and the associated wrist thereof such that the wrist remains substantially straight during actuation of the keyboard, a major portion of the bottom of said at least one pad being flat providing a flat surface which directly engages and is slidable on the bearing surface defined by said plurality of bars, said at least one pad further including downwardly depending end portions straddling said flat surface and said plurality of bars, said depending end portions limiting the range of movement of said at least one pad transversely of said plurality of bars, said at least one pad being freely slidable longitudinally of the plurality of bars between said brackets;

whereby said at least one pad is freely slidable in all directions in the plane defined by the plurality of bars so that the fingers of the operator's hand supported thereby can readily reach and actuate selected keys of the keyboard.

2. The apparatus of claim 1 wherein the plurality of bars have smooth surfaces and the flat surface on said at least one pad is also smooth, and the materials from which said bars and flat surface of said pad are selected so that the coefficient of friction therebetween is from about 0.05 to about 0.08.

3. The apparatus of claim 2 wherein said bars are fabricated from steel and said flat surface on said paid is fabricated from teflon.

4. The apparatus according to claim 1 further including a retaining strap extending longitudinally of said at least one pad between said depending end portions and spaced from said flat surface to thereby enclose the bars between the flat surface and the retaining strap.

5. The apparatus of claim 1 further including adjustment means for adjusting the height of each of the upstanding brackets of the support frame with respect to the keyboard.

6. The apparatus of claim 1 wherein said at least one pad includes a substantially hollow shell forming the curved upper surface and depending end portions, and the bottom of said pad which forms said flat surface is a flat sheet recessed within the bottom of said shell.

7. The apparatus of claim 1 including two of said pads, one for each hand and wrist of an operator.

* * * * *